US006632085B1

(12) United States Patent
Suzuki et al.

(10) Patent No.: US 6,632,085 B1
(45) Date of Patent: Oct. 14, 2003

(54) CATALYST COMBUSTION DEVICE AND FUEL VAPORIZING DEVICE

(75) Inventors: Motohiro Suzuki, Moriguchi (JP); Tatsuo Fujita, Osaka (JP); Yoshitaka Kawasaki, Nabari (JP); Tetsuo Terashima, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 65 days.

(21) Appl. No.: 09/830,054

(22) PCT Filed: Aug. 17, 2000

(86) PCT No.: PCT/JP00/05486

§ 371 (c)(1),
(2), (4) Date: May 22, 2001

(87) PCT Pub. No.: WO01/14793

PCT Pub. Date: Mar. 1, 2001

(30) Foreign Application Priority Data

Aug. 19, 1999 (JP) ..... 11-232923
Mar. 17, 2000 (JP) ..... 2000-076198

(51) Int. Cl.[7] ..... F23D 11/00
(52) U.S. Cl. ..... 431/328; 431/208
(58) Field of Search ..... 431/326, 328, 431/208

(56) References Cited

U.S. PATENT DOCUMENTS 5,352,114 A * 10/1994 Numoto et al. ..... 431/328
5,813,850 A * 9/1998 Lee ..... 431/208
5,938,427 A * 8/1999 Suzuki et al. ..... 431/208

FOREIGN PATENT DOCUMENTS

JP 59-91909 A * 4/1984 ..... 431/328
JP 59-115911 A * 7/1984 ..... 431/328
JP 59-153017 A * 8/1984 ..... 431/328
JP 04-19816 * 11/1990 ..... F23N/5/10
JP 4-198618 7/1992
JP 04198618 A * 7/1992 ..... F23N/5/10
JP 06-249414 * 2/1993 ..... F23D/11/40
JP 6-249414 9/1994
JP 06249414 A * 9/1994 ..... F23D/11/40
JP 10-16914 * 12/1996 ..... F23D/11/40
JP 11-082925 * 9/1997 ..... F23C/11/00
JP 10-169914 6/1998
JP 10169914 A * 6/1998 ..... F23D/11/40
JP 2000-097496 * 9/1998 ..... F24H/3/04
JP 11082925 A * 3/1999 ..... F23C/11/00
JP 11-264514 9/1999
JP 2001-108206 * 10/1999 ..... F23D/11/40
JP 2001-141211 * 11/1999 ..... F23D/11/40
JP 2000097496 A * 4/2000 ..... F24H/3/04
JP 2001108206 A * 4/2001 ..... F23D/11/40
JP 2001141211 A * 5/2001 ..... F23D/11/40
WO WO 02/10644 A1 * 2/2002

OTHER PUBLICATIONS

International Search Report, application No. PCT/JP00/05486, dated Dec. 19, 2000.

* cited by examiner

*Primary Examiner*—Henry Bennett
*Assistant Examiner*—James G. Barrow
(74) *Attorney, Agent, or Firm*—RatnerPrestia

(57) ABSTRACT

A catalyst combustion apparatus, includes: a fuel feed course for feeding liquid fuel; an air feed course for feeding air; a mixing unit for mixing fuel to be fed from the fuel feed course with air to be fed from the air feed course; a vaporizing unit for heating mixture-obtained by mixing in the mixing unit to vaporize the liquid fuel; a catalyst heating unit disposed on the downstream side of the vaporizing unit in contact with or in close proximity to the vaporizing unit in terms of conduction of heat, for carrying an oxidation catalyst component; and a catalyst combustion unit provided on the downstream of the catalyst heating unit, having a multiplicity of conductive holes, and the vaporizing unit is capable of utilizing heat from the catalyst heating unit.

18 Claims, 7 Drawing Sheets

CATALYST COMBUSTION DEVICE AND FUEL VAPORIZING DEVICE

This Application is a U.S. National Phase Application of PCT International application PCT/JP00/05486.

TECHNICAL FIELD

The present invention relates to a catalyst combustion apparatus using liquid fuel, and a vaporizing apparatus for liquid fuel.

BACKGROUND ART

As a method for vaporizing liquid fuel, there have conventionally been proposed a large number of methods. Of these methods, a method for dropping liquid fuel in a vaporizing unit for vaporizing, a method for jetting after vaporizing by way of a vaporizing element provided within a vaporizing unit, or the like have been utilized for household oil burning appliances and are well known.

In any of those methods, from a heat of vaporization recovery ring provided in a burner port portion of flames to be formed, a heat receptor for recovery of heat of vaporization arranged with its one part projecting into flames, or the like, heat recovery is performed to the vaporizing unit through conduction of heat.

In the above-described conventional vaporizing apparatus, since flames to be formed and atmosphere in its vicinity have as high temperature as 1100 to 1300° C., heat recovery is performed from a heat of vaporization recovery ring provided in the burner port portion, a heat receptor for recovery of heat of vaporization arranged with its one part projecting into flames, or the like to the vaporizing unit by the conduction of heat, whereby spontaneous combustion could be made.

In a catalyst combustion apparatus, however, since temperature within a catalyst combustion unit is restricted on 900° C., which is the heat limit, or less, a heat recovery source at lower temperature is used, and therefore, the similar configuration of vaporizing unit to the conventional one has had a problem that a heater for the vaporizing unit requires a great deal of power consumption in order to continue the catalyst combustion.

In addition, it has had another problem that a part of the fuel would re-condense if a sufficient amount of heat is not given.

DISCLOSURE OF THE INVENTION

It is an object of the present invention to solve the above-described conventional problems concerning the catalyst combustion apparatus.

The present invention is a catalyst combustion apparatus comprising:

a fuel feed course for feeding liquid fuel;

an air feed course for feeding air;

a mixing unit for mixing fuel to be fed from said fuel feed course with air to be fed from said air feed course;

a vaporizing unit for heating mixture obtained by mixing in said mixing unit to vaporize said liquid fuel;

a catalyst heating unit disposed on a downstream side of said vaporizing unit in contact with or in close proximity to said vaporizing unit in terms of conduction of heat, for carrying an oxidation catalyst component; and a catalyst combustion unit, provided on a downstream side of said catalyst heating unit, having a multiplicity of conductive holes, and wherein said vaporizing unit is capable of utilizing heat from said catalyst heating unit.

The present invention is a catalyst combustion apparatus comprising:

a fuel feed course for feeding liquid fuel;

an air feed course for feeding air;

a vaporizing unit for heating fuel to be fed from said fuel feed course to vaporize;

a mixing unit for mixing vaporized fuel fed from said vaporizing unit with air fed from said air feed course;

a catalyst heating unit disposed on a downstream side of said mixing unit in contact with or in close proximity to said vaporizing unit in terms of conduction of heat, for carrying an oxidation catalyst component; and a catalyst combustion unit, provided on a downstream side of said catalyst heating unit, having a multiplicity of conductive holes, and wherein said vaporizing unit is capable of utilizing heat from said catalyst heating unit.

The present invention is a fuel vaporizing apparatus, characterized in that said apparatus comprises:

a fuel feed course for feeding liquid fuel;

an air feed course for feeding air;

a vaporizing unit having a vaporizing surface for heating fuel to be fed from said fuel feed course to vaporize said liquid fuel;

a first mixing space for mixing air fed from said air feed course with fuel vaporized in said vaporizing unit; and a second mixing space provided on the downstream side of said first mixing space, and a tip end of said air feed course penetrates said vaporizing surface to thereby cause a part of air jetted from said tip end to flow out of said first mixing space without being affected by heating in said vaporizing unit, while the remaining air is mixed with said fuel vaporized within said first mixing space, into mixture, to flow out of said first mixing space, and in said second mixing space in the outside of said first mixing space, said air flowed out is mixed with said mixture.

The present invention is a fuel vaporizing apparatus comprising:

a fuel feed course for feeding liquid fuel;

an air feed course for feeding air; and a vaporizing unit having a vaporizing surface for heating fuel to be fed from said fuel feed course to vaporize said liquid fuel, and wherein said vaporizing unit is formed into a box-shaped case; within said case, a tip end of said fuel feed course and a tip end of said air feed course are arranged; fuel is jetted through the tip end of said fuel feed course toward the vaporizing surface located in the base portion of said case; and within said case, vaporized fuel and air jetted from the tip end of said air feed course are mixed to flow out of an opening located on the side of said case.

DESCRIPTION OF THE SYMBOLS

Figure 1:
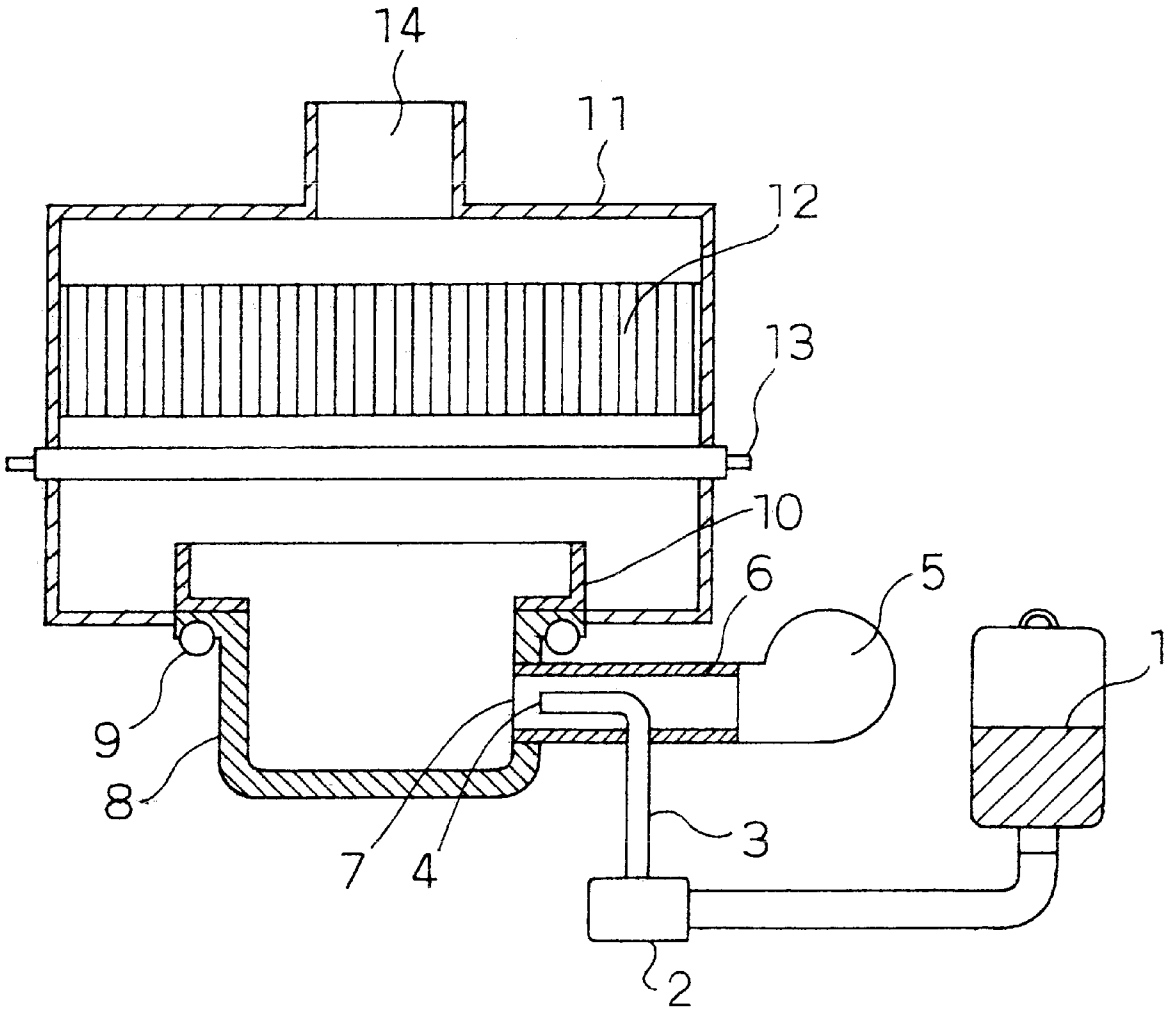
FIG. 1 is a partial sectional block diagram showing a combustion apparatus according to a first embodiment of the present invention.

1 Fuel tank
2 Fuel feed pump
3 Fuel feed course
4 Fuel jet port
5 Air feed fan
6 Air feed course
7 Air jet port
8 Vaporizing unit
9 Vaporizing unit heater
10 Catalyst heating unit
11 Combustion chamber
12 Catalyst combustion unit
13 Catalyst heater
14 Combustion gas exhaust port
15 Mixture space
16 Catalyst heating unit conductive holes
17 vaporizing unit through-hole
18 Diverting air port
19 Current plate
101 Fuel feed course
102 Fuel jet port
103 Vaporizing surface
104 Heater
105 Air feed course
106 Case
107 Mixture space
108 Air diverting port
109 Catalyst combustion unit
110 High-emissivity film
111 Radiation heat receptor
112 Vaporizing unit opening
113 Mixture circulation port
114 Current plate
115 Liquid fuel diverting unit
120 Fuel-vaporizing apparatus
121 Catalyst combustion apparatus

MODE FOR CARRYING OUT THE INVENTION

Hereinafter, with reference to the drawings, the description will be made of embodiments of the present invention.

In order to carry out the present invention, in addition to a catalyst body having a multiplicity of conductive holes and oxidative activity to various fuel, and a vaporizing unit for liquid fuel, an ignition device and a flow rate control device, or, as required, a temperature detection device, a driving unit or the like are required. As the catalyst body, a honeycomb carrier for metal or ceramics, or a plaiting body of ceramic fiber, a porous sintered body or the like carrying an active constituent mainly composed of noble metal such as platinum and palladium can. be used. Also, as air-introduction porous body, there can be used honeycomb structure of ceramics, or a plaiting body of ceramic fiber, porous sintered body or the like. Further, in order to control air flow rate, a manual needle valve or a motor-driven solenoid valve or the like are used, and in order to control flow rate of liquid fuel, an electromagnetic pump or the like is used. For the other driving portions, manual lever operation, automatically-controlled motor driving or the like can be used. As an ignition device, an electric heater, a discharging igniter or the like can be used. In this respect, they have all been means widely used conventionally, and any other known means can be used.

First Embodiment

FIG. 1 is a partial sectional block diagram showing a catalyst combustion apparatus according to an embodiment of the present invention.

In FIG. 1, reference numeral 1 denotes a fuel tank; 2, a fuel feed pump; 3, a fuel feed course; 4, a fuel jet port; 5, an air feed fan; 6; an air feed course; 7, an air jet port: 8, a vaporizing unit, whose inner side is coated with black heat-resisting paint; 9, a vaporizing unit heater; and 10, a catalyst heating unit obtained by causing metallic base material to carry noble metal of platinum group, which is provided so as to come into contact with the vaporizing unit 8.

Further, reference numeral 11 denotes a combustion chamber; 12, a catalyst combustion unit obtained by causing a ceramic honeycomb having a multiplicity of conductive holes to carry noble metal of platinum group; 13, a catalyst heater; and 11, a combustion gas discharge port.

Next, with reference to FIG. 1, the description will be made of an operation and characteristics of the present embodiment. Liquid fuel (kerosene is used here) within the fuel tank 1 is jetted into the air feed course 6 from the fuel jet port 4 by way of the fuel feed course 3 after its flow rate is controlled at the fuel feed pump 2.

Also, air is fed by the air feed fan 1, to which voltage is applied so as to provide an adequate air flow rate, and is jetted into the vaporizing unit 8 from the air jet port 7 after mixed with liquid fuel by way of the air feed course 6.

Further, premixed mixture to be jetted from the air jet port 7 collides against a wall, which is opposed thereto, in the vaporizing unit 8, which is controlled to exceed 250° C. under the ON-OFF control of the vaporizing unit heater 9, and the liquid fuel is vaporized there.

Also, the greater part of the premixed mixture consisting of the liquid fuel thus vaporized and air is directly fed to the catalyst combustion unit 12.

In this case, an amount of feed is adjusted by the fuel feed pump 2 correspondingly to the amount of combustion, whereby the gas on the upstream surface in the catalyst combustion unit 12 has excellent combustion exhaust gas characteristics and its temperature is controlled to exceed 500° C., at which the combustion is allowed to be continued, and not to exceed 900° C., which is a heat limit.

At this time, an amount of heat equal to 50 to 60% of an calorific value of the liquid fuel to be fed is emitted on the upstream side of the catalyst combustion unit 12. Also, a part of the premixed mixture comes into contact with the catalyst heating unit 10, which has been arranged in contact with the vaporizing unit 8, to perform a catalyst reaction (however, contact frequency of the premixed mixture with the catalyst heating unit 10 varies with the amount of combustion). At this time, because of heat to be generated by this catalyst reaction, and radiation heat to be flowed back from the catalyst combustion unit 12, the catalyst heating unit 10 is maintained at temperatures of 400 to about 600° C., at which lowered catalyst activity is not noticeably affected.

Further, a part of heat of reaction generated at the catalyst heating unit 10 is transmitted to the vaporizing unit 8 arranged in contact by conduction of heat. Also, a part of radiation heat of the catalyst heating unit 12 on the upstream side is directly flowed back to the vaporizing unit 8 by way of an opening of the catalyst heating unit 10.

Further, in the vaporizing unit 8, heat of conduction from the catalyst heating unit 10, and radiation heat from the catalyst combustion unit 12 are utilized together with heat of vaporization from the liquid fuel for preheating of the premixed mixture, and therefore, a part of these heat is flowed back to the catalyst combustion unit 12 again.

As described above, due to flow-back effect of heat of reaction in the catalyst heating unit 10 and the catalyst combustion unit 12. to the vaporizing unit 8, power consumption of the vaporizing unit heater 9 required to control the vaporizing unit 8 to exceed 250° C. can be greatly reduced, and due to preheating effect of the premixed mixture, it becomes possible to reduce the fuel consumption, that is, to realize high heat utilization efficiency. Therefore, it is possible to provide a catalyst combustion apparatus having high heat utilization efficiency, excellent in energy-saving property and cost effectiveness.

Second Embodiment

The description will be made of a second embodiment according to the present invention. The present embodiment is the same in basic configuration as the first embodiment, but is different in that between the vaporizing unit 8 and the catalyst combustion unit 12, there is provided restriction means 210 of restraining the flow of mixture to the catalyst combustion unit 12. Accordingly, the description will be mainly made of this point of difference.

Figure 2:
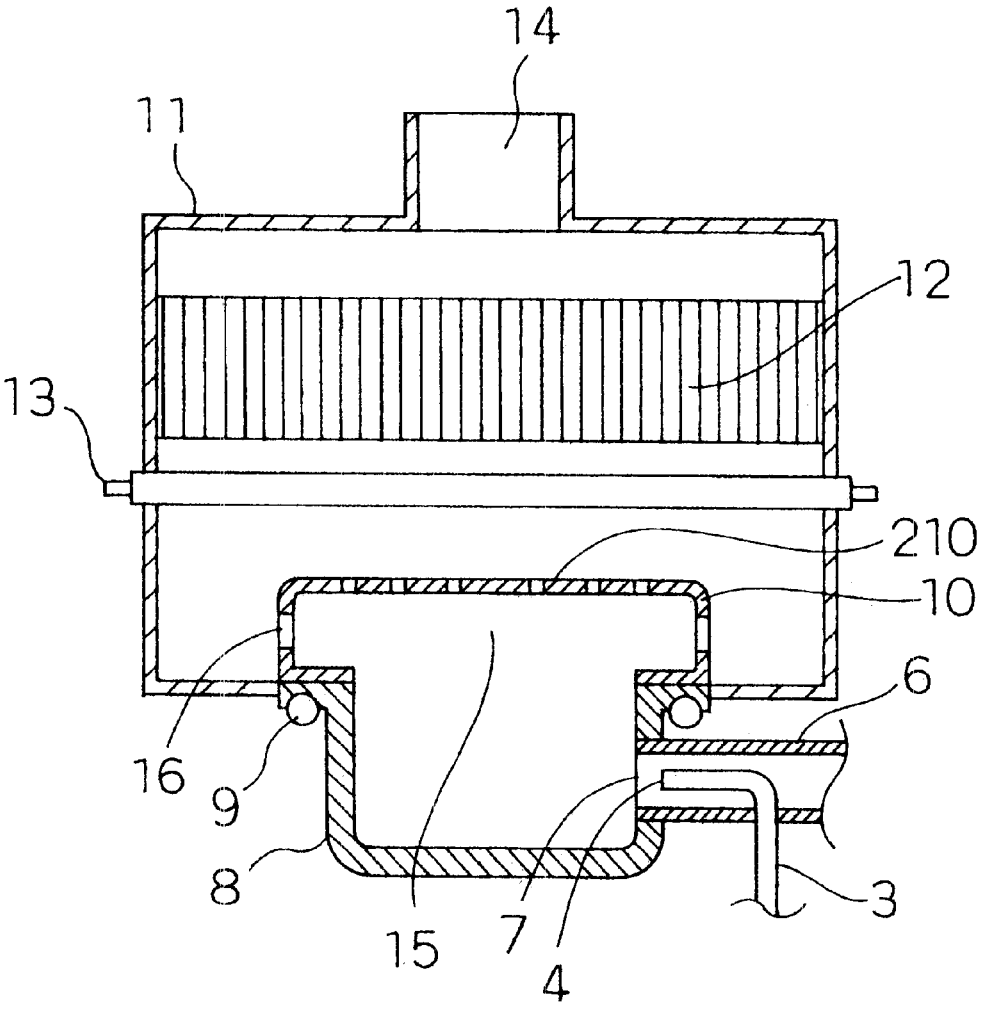
FIG. 2 is an essential sectional block diagram showing a combustion apparatus according to a second embodiment of the present invention.

FIG. 2 is an essential sectional view showing the present embodiment. In FIG. 2, a reference numeral 15 denotes a space portion of mixture, provided between a vaporizing unit 8 and a catalyst heating unit 10, which is space in which the mixture circulates. Also, a reference numeral 16 denotes conductive holes provided in the catalyst heating unit 10. The catalyst heating unit 10 is box-shaped, and is arranged to couple to the vaporizing unit 8 in terms of conduction of heat so as to cover it. On the base portion and the side portions of the catalyst heating unit 10, catalyst heating unit conductive holes 16,are provided, through which the mixture flows out of the catalyst heating unit 10. Such a catalyst heating unit 10 constitutes the full or partial restriction means 210 according to the present invention.

In this respect, the box-shape written in the present specification includes a cylindrical shape, to say nothing of a rectangular parallelepiped shape and widely includes not only 90 degrees in shape of the angle portion, but also any round shapes.

Next, with reference to FIG. 2, the description will be made of an operation and characteristics of the present embodiment.

In the same way as the first embodiment, premixed mixture to be jetted from the air jet port 7 collides against a wall, which is opposed thereto, in the vaporizing unit 8, which is controlled to exceed 250° C. under the ON-OFF control of the vaporizing unit heater 9, and the liquid fuel is vaporized here.

The premixed mixture consisting of the liquid fuel thus vaporized and air passes through mixture space 15, and thereafter, comes into contact with the catalyst heating unit 10 for reaction, which has been arranged in contact with the vaporizing unit 8, and is fed to the catalyst combustion unit 12 by way of catalyst heating unit conductive holes 16.

At this time, heat generated by this catalyst reaction and radiation heat to be flowed back from the catalyst combustion unit 12 maintain the catalyst heating unit 10 at temperatures of 600 to 800° C.

Further, a part of heat of reaction to be generated in the catalyst heating unit 10 is transmitted to the vaporizing unit 8 due to conduction of heat from a portion installed in contact and heat radiation from a surface opposite to the vaporizing unit 8.

Also, in the vaporizing unit 8, heat of conduction and radiation heat from the catalyst heating unit 10 are also utilized for preheating of premixed mixture together with heat of vaporization of liquid fuel, and therefore, a part of these heat is flowed back to the catalyst combustion unit 12 by way of the catalyst heating unit 10 again.

As described above, due to flow-back effect of heat of reaction in the catalyst heating unit 10 and the catalyst combustion unit 12 to the vaporizing unit 8, the power consumption of the vaporizing unit heater 9 required to control the vaporizing unit 8 to exceed 250° C. can be greatly reduced, and due to preheating effect of the premixed mixture, it becomes possible to reduce the fuel consumption, that is, to realize high heat utilization efficiency.

Also, since the catalyst heating unit 10 is box-shaped, there is an advantage that the mixture is sufficiently fed to the catalyst heating unit 10, and the reaction of the catalyst heating unit 10 occurs more actively.

Also, since the catalyst heating unit 10 is box-shaped, there is an advantage-that the mixture is sufficiently mixed within, and is discharged toward outside.

Therefore, it is possible to provide a catalyst combustion apparatus having high heat utilization efficiency, excellent in energy-saving property and cost effectiveness.

Further, since the greater part of heat recovery from the catalyst heating unit 10 to the vaporizing unit 8 is performed as described above, even when the catalyst combustion unit 12 is not provided downstream, that is, it is also applicable to a flame combustion apparatus, and a widely applicable vaporizing apparatus can be provided.

In this respect, in the present embodiment, the catalyst heating unit 10 has entirely been made of metallic base material, but the neighborhood of the catalyst heating unit conductive holes 16 may be replaced with a ceramic honeycomb having a multiplicity of conductive holes carrying noble metal of platinum group, and the same effect as described above can be obtained. In the case where lower catalytic activity when used for a long term is taken into consideration, a better tendency can be obtained.

Third Embodiment

The description will be made of a third embodiment according to the present invention. The present embodiment is the same in basic configuration as the second embodiment, but is different in that an air jet port at the tip end of the air feed course is caused to penetrate the vaporizing unit in order to prevent air to be fed from the air feed course from coming into contact with the vaporizing unit for being heated as far as possible, and that part of the fuel feed course is provided within the vaporizing unit. Accordingly, the description will be mainly made of these points of difference.

Figure 3:
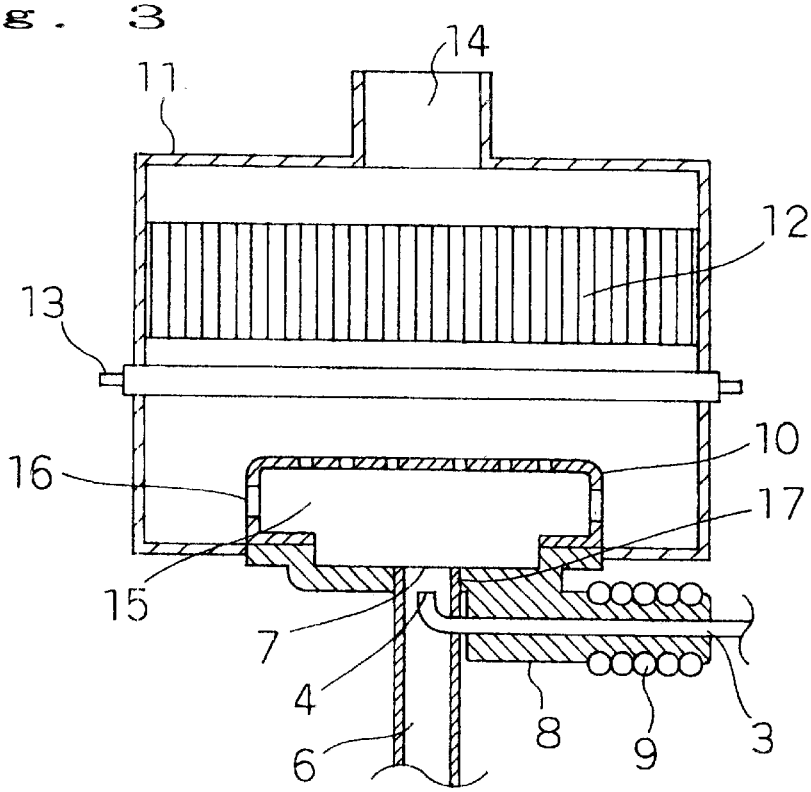
FIG. 3 is an essential sectional block diagram showing a combustion apparatus according to a third embodiment of the present invention.

FIG. 3 is an essential sectional view showing the present embodiment.

In FIG. 3, a reference numeral 17 denotes a vaporizing unit through-hole, and an air jet port 7 at the tip end of the air feed course 6 is caused to penetrate the vaporizing unit.

Liquid fuel within the fuel tank 1 passes through the fuel feed course 3 embedded and provided within the vaporizing unit 8 after the flow rate. of the liquid fuel is controlled at the fuel feed pump 2.

In the fuel feed course 3, the liquid fuel is controlled to exceed 250° C. under the ON-OFF control of the vaporizing unit heater 9, and therefore, the liquid fuel is vaporized while passing through the interior of the vaporizing unit 8, and thereafter, is jetted from a fuel jet port 4 into the air feed course 6.

Since the periphery of a portion where the fuel feed course 3 has been arranged within the vaporizing unit 8 is covered with a vaporizing unit heater 9, there is also provided an insulation effect for restraining radiation of heat from the vaporizing unit 8.

Also, air is fed by the air feed fan 1, to which voltage is applied so as to provide an adequate air flow rate, and is jetted into mixture space 15 from the air jet port 7 after mixed with fuel gas by way of the air feed course 6.

Also, since the air jet port 7 at the tip end of the air feed course 6 is set up so as to penetrate the vaporizing unit 8, premixed mixture of vaporized liquid fuel and air flows into air mixture space 15 without coming into direct contact with the vaporizing unit 8, and after passing through the space 15, comes into contact with a catalyst heating unit 10 arranged in contact with the vaporizing unit 8 for reaction, and. is fed to a catalyst combustion unit 12 by way of catalyst heating unit through-holes 16. In this respect, although it is written that the air jet port 7 is caused to penetrate the vaporizing unit 8, in the present embodiment, strictly speaking, the air jet port 7 is in contact with part of the vaporizing unit 8. However, since the jet direction of air is set to right above, it can be said that it is hardly affected by the heating in the vaporizing unit 8, and that the air jet port 7 completely penetrates the vaporizing unit 8 really.

At this time, heat generated by this catalyst reaction and radiation heat to be flowed back from the catalyst combustion unit 12 maintain the catalyst heating unit 10 at temperatures of 600 to 800° C.

Further, part of heat of reaction to be generated in the catalyst heating unit 10 is transmitted to the vaporizing unit 8 due to conduction of heat from a portion installed in contact and heat radiation from a surface opposite to the vaporizing unit 8.

Also, in the vaporizing unit 8, heat of conduction and radiation heat from the catalyst heating unit 10 are only utilized to vaporize the liquid fuel, and therefore, the amount of heat to be fed to the vaporizing unit 8 can be reduced to one eighth to one sixth when vaporized as premixed mixture.

As described above, the power consumption of the vaporizing unit heater 9 required to control the vaporizing unit 8 to exceed 250° C. can be reduced to substantially zero, and spontaneous combustion can be implemented.

Therefore, it is possible to provide a catalyst combustion apparatus excellent in cost effectiveness with low running cost.

Further, since the greater part of heat recovery from the catalyst heating unit 10 to the vaporizing unit 8 is performed as described above, even when the catalyst combustion unit 12 is not provided downstream, that is, it is also applicable to a flame combustion apparatus, and a widely applicable vaporizing apparatus can be provided.

In this respect, in the prevent embodiment, the liquid fuel vaporized is once jetted into the air feed course 6 from the fuel jet port 4, but it may be possible to mix with air after directly jetted into the mixture space 15, and the same effect as described above can be obtained.

Fourth Embodiment

The description will be made of a fourth embodiment according to the present invention. The present embodiment is the same in basic configuration as the third embodiment, but is different in that a diverting air port 18 is provided at a downstream position of the air jet port 7 of the catalyst heating unit 10 in such a manner that part of air does not come into contact with the catalyst heating unit 10, that a current plate 19 for promoting mixture of diverted air and mixture is provided at a position close to the catalyst combustion unit 12 downstream of the diverting air port 18 in the state of contacting with the heater 13, and that there is provided a fuel jet port 4 at the tip end of the fuel feed course 3 so that liquid fuel provided from the fuel feed course 3 collide with the vaporizing unit 8.

Accordingly, the description will be mainly made of these points of difference.

Figure 4:
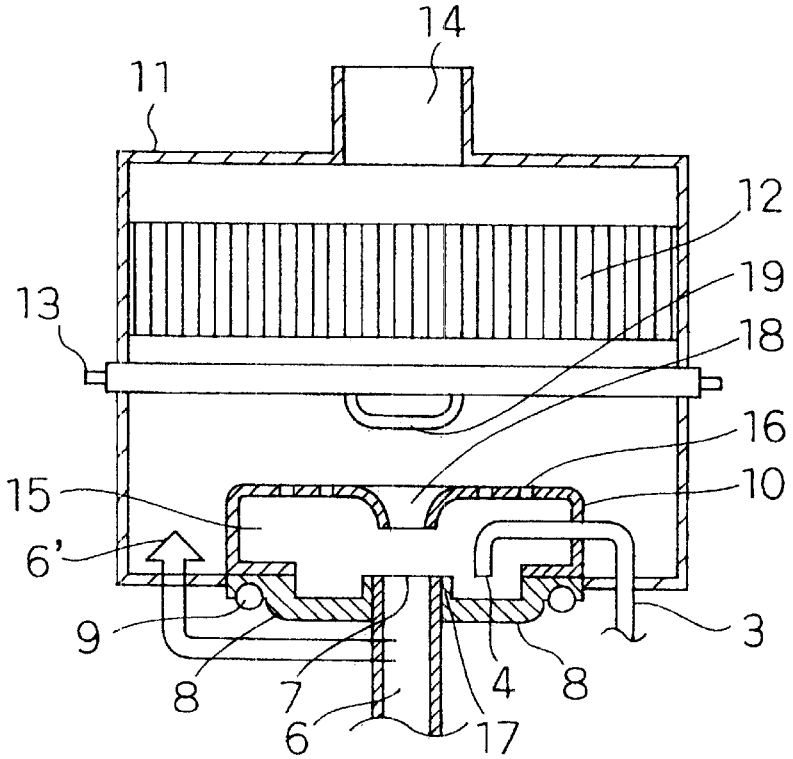
FIG. 4 is an essential sectional block diagram showing a combustion apparatus according to a fourth embodiment of the present invention.

FIG. 4 is an essential sectional view showing the present embodiment. In FIG. 4, an opening provided at the center of the catalyst heating unit 10 is an diverting air port 18, through which diverted air passes.

A current plate 19 is arranged downstream of the diverting air port 18, and this current plate 19 is arranged in contact with a heater 13 for heating the catalyst combustion unit 12. The current plate 19 is configured by causing metallic base material to carry noble metal of platinum group.

Next, with reference to FIG. 4, the description will be made of an operation and characteristics of the present embodiment.

Liquid fuel within the fuel tank 1 is jetted into the mixture space 15 from the fuel jet port 4 by way of the fuel feed course 3 after its flow rate is controlled at the fuel feed pump 2.

Further, liquid fuel to be jetted from the fuel jet port 4 collides against a wall, which is opposed thereto, in the vaporizing unit 8, which is controlled to exceed 250° C. under the ON-OFF control of the vaporizing unit heater 9, and within the vaporizing unit 8, the liquid fuel is vaporized.

Also, air is fed by the air feed fan 1, to which voltage is applied so as to provide an adequate air flow rate, and is jetted into the mixture space 15 from the air jet port 7 by way of the air feed course 6, but the air jet port 7 at the tip end of the air feed course 6 is provided to penetrate the vaporizing unit 8. Therefore, the air flows straight toward the catalyst combustion unit 12 without coming into direct contact with the vaporizing unit 8, and part of the air is fed to outside of the diverting air port 18, directly into the combustion chamber 11 without mixing with the liquid fuel vaporized.

The air which did not flow out at the diverting air port 18 is mixed with the liquid fuel which has collided with the wall, to which the vaporizing unit 8 is opposed, and has been vaporized, within the mixture space 15, and thereafter, comes into contact with the catalyst heating unit 10 arranged so as to contact the vaporizing unit 8 for reaction (however, condition of insufficient air for the adequate air flow rate) and passes through the catalyst heating unit conductive holes 16.

On the other hand, the air which has passed through the diverting air port 18 forms a flow toward a flow of the premixed mixture to be formed in the circumference of the center of the combustion chamber 11 because of collision with a current plate 19, and after mixed with the premixed mixture, is fed to the catalyst combustion unit 12.

At this time, due to heat to be generated by this catalyst reaction, and radiation heat to be flowed back from the catalyst combustion unit 12, a condition that air is insufficient for the adequate air flow rate is met, and therefore, the temperature of the catalyst heating unit 10 is lower than that of the third embodiment, and is maintained at temperatures of 500 to 700° C., at which lowered catalyst activity is not noticeably affected.

Further, since the current plate 19 is provided in the vicinity of the catalyst combustion unit 12 although it comes into contact with diverted air at as low temperatures as about 50° C., it becomes possible to restrain tar from adhering thereto.

Even when tar adheres, by the passage of electric current through the catalyst combustion unit heater 13 before commencement of catalyst combustion, the current plate 19 also rises in temperature, and decomposition reaction of tar is performed on the surface of catalyst carried on the current plate 19. Therefore, there is no possibility that problems such as malodor due to accumulation of tar is raised.

Further, since the catalyst combustion unit 12 has excellent combustion exhaust gas characteristics, the same degree of mixture characteristics as when premixed mixture is fed can be realized with the provision of the current plate 19.

Further, part of heat of reaction to be generated in the catalyst heating unit 10 is transmitted to the vaporizing unit 8 due to conduction of heat from a portion installed in contact and heat radiation from a surface opposite to the vaporizing unit 8.

Also, in the vaporizing unit 8, heat of conduction and radiation heat from the catalyst heating unit 10 are only utilized to vaporize the liquid fuel, and therefore, the amount of heat to be fed to the vaporizing unit 8 can be reduced. to one eighth to one sixth when it is vaporized as premixed mixture.

In addition, air is diverted and flow rate of the premixed mixture, which comes into contact with the catalyst heating unit 10, is reduced, whereby an amount of heat recovery from the catalyst heating unit 10 to the premixed mixture is reduced, and therefore, the power consumption of the vaporizing unit heater 9 required to control the vaporizing unit 8 to exceed 250° C. can be reduced to zero over all the combustion amount areas as described above, and spontaneous combustion can be realized.

Therefore, it is possible to provide a catalyst combustion apparatus excellent in cost effectiveness with low running cost.

Further, since the greater part of heat recovery from the catalyst heating unit 10 to the vaporizing unit 8 is performed as described above, even when the catalyst combustion unit 12 is not provided downstream, that is, it is also applicable to a flame combustion apparatus, and a widely applicable vaporizing apparatus can be provided.

In this respect, in the present embodiment, the current plate 19 is provided so as to contact the catalyst combustion unit heater 13, but it maybe possible to isolate for setting up, and if the current plate 19 is arranged. in the vicinity of the catalyst combustion unit 12, the same effect as described above can be obtained.

Also, air diverted from the diverting air port 18 opened in the catalyst heating unit 10 has been circulated, but it may be possible to feed air into the combustion chamber 11 after the air is diverted upstream of the vaporizing unit 8 in advance (See 6 in FIG. 4), and the same effect as described above can be obtained although the configuration of the combustion apparatus becomes slightly complicated.

Further, as ignition means, there has been used a heat rising system from upstream of a catalyst combustion unit using the catalyst combustion unit heater 12, but when a piezo-electric igniter is used as an igniter to be used when catalyst combustion is started by flame combustion, a catalyst combustion apparatus without power supply can be realized.

In the foregoing, the description has been made of an example in which the present invention is applied to a catalyst combustion apparatus using liquid fuel, but the present invention is not limited thereto as a matter of course. In other words, the following cases are also included in the present invention.

For the carrier of the catalyst combustion unit, ceramic honeycomb is used, but as long as it has a multiplicity of conductive holes in which premixed mixture can be circulated, it is not limited to its material and shape, but a sintered body of, for example, ceramics and metal, metallic honeycomb and metallic nonwoven material, a plaiting body of ceramic fiber or the like can be utilized, the shape is also not limited to a flat plate, but a curved shape, a cartridge shape or a corrugated panel shape or the like can be arbitrarily set in accordance with processability and applications of the material.

As active constituent, there are generally noble metal of platinum group such as platinum, palladium, and rhodium, and their mixing body, other metals and their oxide, and their mixing composition may be used, and the active constituent responsive for type of fuel and conditions for use can be selected.

On the outer peripheral wall of the combustion chamber, there may be provided a heat ray permeating window made of crystallization glass, quartz glass, or the like, through which heat ray is permeated, or in place of the heat ray permeating window, a secondary radiator configured by material with excellent thermal conductivity having high surface emissivity, a radiation heat receptor, or the like added with heating medium passage made of copper pipe or the like may be provided, and in either case, the same effect as described above can be obtained.

Further, as ignition means, there has been used a heat rising system from the upper stream of the catalyst combustion unit using an electric heater, but as an igniter for starting flame combustion, the use of a piezo-electric igniter is effective means for completing the equipment without power supply.

Next, with reference to the drawings, the description will be made of embodiments of the present invention.

Fifth Embodiment

Figure 5:
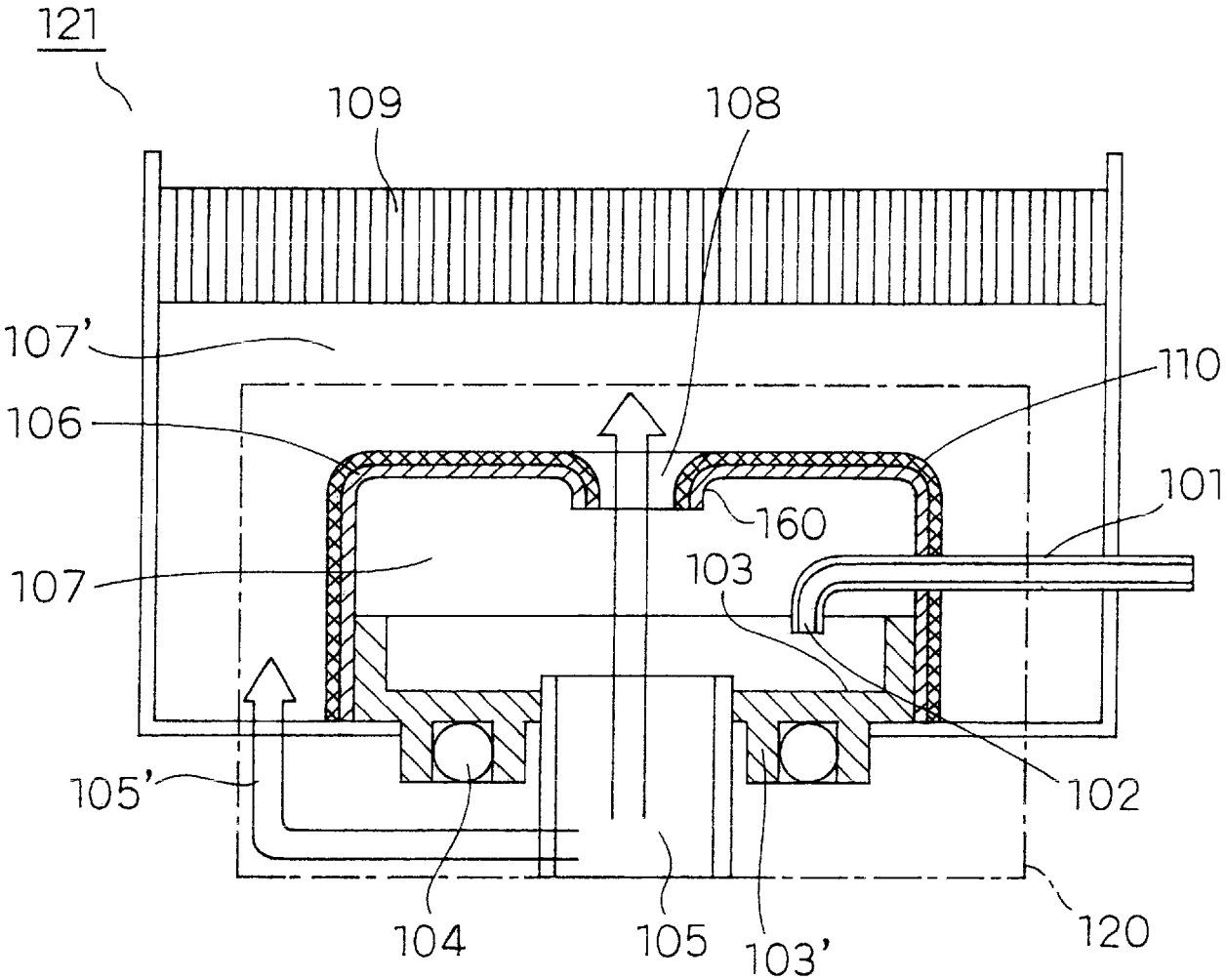
FIG. 5 is an essential sectional block diagram showing a fuel vaporizing apparatus according to an embodiment of the present invention and a catalyst combustion apparatus using the same.

FIG. 5 is an essential sectional block diagram showing a fuel vaporizing apparatus according to an embodiment of the present invention and a catalyst combustion apparatus using the same. A reference numeral 101 denotes a fuel feed course; 102, a fuel jet port; 103, a vaporizing surface of a vaporizing unit 103'; 104, a heater; and 105, an air feed course, the tip end of which is caused to penetrate part of the vaporizing surface 103. The vaporizing unit 103' has a box shape, and the under surface thereof is mounted with a heater 104.

A reference numeral 107 denotes mixture space as an example of first mixture space; 107', second mixture space; 108, an air diverting port; and 109, a catalyst combustion unit, which is arranged downstream of the mixture space 107, carrying platinum group catalytic component in the ceramic honeycomb. A reference numeral 110 denotes high-emissivity film, which covers the surface of a case 106 forming the mixture space 107 on the catalyst combustion unit 109 side. The first mixture space 107 is formed by a box-shaped case 106, and is arranged to cover the vaporizing unit 103'. Further, the case 106 is coupled to the vaporizing unit 103' in terms of conduction of heat.

Further, in the base portion (exists above in the figure) of the case 106 for forming the mixture space 107, there is formed an air diverting port 108. An edge 60 of the air diverting port 108 protrudes toward the interior of the mixture space 107.

The tip end of the fuel feed course 101 is oriented, toward the vaporizing surface 103 of the vaporizing unit 103' so that the liquid fuel collides with the vaporizing surface 103. Further, the air feed course 105 is arranged such that the air can be jetted toward the center of the base portion of the case 106. As described above, there is opened the air diverting port 108 at the center of the base portion.

The fuel vaporizing apparatus 120 is configured by the fuel feed course 101, the fuel jet port 102, the vaporizing surface 103, the air feed course 105, the first mixture space 107, the second mixture space 107' and the air diverting port 108, and the fuel vaporizing apparatus 120 is combined with the catalyst combustion unit 109 to constitute a catalyst combustion apparatus 121. The heater 104 is used when the temperature on the vaporizing surface 103 is so insufficient that vaporization cannot be sufficiently performed such as during rising.

Next, the description will be made of an operation of the present embodiment.

Liquid fuel (kerosene is used here) to be fed is jetted toward the vaporizing surface 103 through the fuel jet port 102 at the tip end by way of the fuel feed course 101. In this case, during starting and when insufficient in amount of heat, the temperature of the vaporizing surface 103 is controlled to maintain the temperature of vaporization of the fuel or higher (250° C. or higher in kerosene) under the ON-OFF control of the heater 104 provided, and the liquid fuel is vaporized here. Of course, even if no electric power is given to the heater 104, vaporization will be performed if the temperature on the vaporizing surface 103 is high.

Air for combustion to be fed by way of the air feed course 105, whose tip end is caused to penetrate the vaporizing surface 103, flows straight upward, and the greater part thereof is discharged out of the air diverting port 108, and part flows into the mixture space 107.

This part of air diverted is circulated on the vaporizing surface 103 and within the mixture space 107, is mixed with the liquid fuel vaporized on the vaporizing surface 103 here, further is mixed while mounting on a flow of air to be fed from the air feed course 105, and thereafter, is discharged out of the mixture space 107 by way of the air diverting port 108.

With such a configuration, part of air to be fed from the air feed course 105 is discharged out of the mixture space 107 without coming into contact with the vaporizing unit 103' as it is, that is, without being heated by means of heat for heating the vaporizing unit 103', and remaining air is mixed with fuel vaporized while flowing within the mixture space 107 to leave the mixture space 107 in the course of time.

Thereby, it becomes possible to realize excellent mixture characteristics, and the flow rate of air which circulates within the mixture space 107 to come into contact with the vaporizing surface 103 becomes smaller than when there is no air directly leaving the mixture space 107 from the air feed course 105. As a result, during vaporization, air is not heated wastefully, but its heating energy is effectively used for vaporizing the liquid fuel, and there is provided an effect that the amount of heat required to vaporize can be greatly reduced.

The mixture discharged out of the air diverting port 108 is further mixed in the second mixture space 107', and is fed to a catalyst combustion unit 109 provided downstream thereof, in which oxidation reaction is performed.

Due to this heat of reaction, the temperature on the surface of the upper stream of the catalyst combustion unit 109 is maintained at 500° C. or to exceed 500° C. capable of continuing the combustion and at 900° C., which is temperature limit at which durability is taken into consideration, or lower.

At this time, an amount of heat corresponding to 50 to 60% of calorific value of the liquid fuel to be fed by means of catalyst combustion on the catalyst combustion unit 109 is radiated on the upstream side of the catalyst combustion unit 109.

Since the case 106 of the first mixture space 107 is covered with the high-emissivity film 110, of radiation heat for reaching from the catalyst combustion unit 109, 90% or higher radiates secondary heat from the surface opposing to the vaporizing surface 103 of the case 106 after absorbed by the high-emissivity film 110. Further, the heat of the case 106 is transmitted to the vaporizing surface 103 of the vaporizing unit 103 from a portion contiguous to the case 106 by conduction of heat to be used for vaporizing the liquid fuel.

As a result, the fuel is vaporized through heat of combustion from the catalyst combustion unit 109 and there is obtained the effect that the electric power for the heater 109 will be hardly needed. Further, since the radiation heat from the catalyst combustion unit 109 is utilized for preheating the premixed mixture together with vaporization of the liquid fuel, part of these is flowed back to the catalyst combustion unit 109 again, and there is obtained the effect that the energy will not be used wastefully.

In the foregoing, it has been shown that it is possible to provide a catalyst combustion apparatus having high heat utilization efficiency, excellent in energy-saving property and cost effectiveness.

In this respect, in the present embodiment, the surface of the case 106 on the catalyst combustion unit 109 side has been covered with the high-emissivity film 110, but it may be possible to configure the case 106 itself by base material with high-emissivity.

Also, when the case 106 is configured by base material having high thermal conductivity such as copper and aluminum, or when integrally configured with the vaporizing surface 103 so as to restrain the contact thermal resistance, it becomes possible to more effectively transmit radiation heat from the surface of the upper stream of the catalyst combustion unit 109 to the vaporizing surface 103, and further the effect equal to or better than the above-described one can be expected.

The present invention may also be applied to such a configuration that the air feed course 105 is diverged on the upstream side and one 105 of them is caused not to pass through the first mixture space 107 at all as shown in the figure, but is directly conducted to the second mixture space 107'.

Sixth Embodiment

Figure 6:
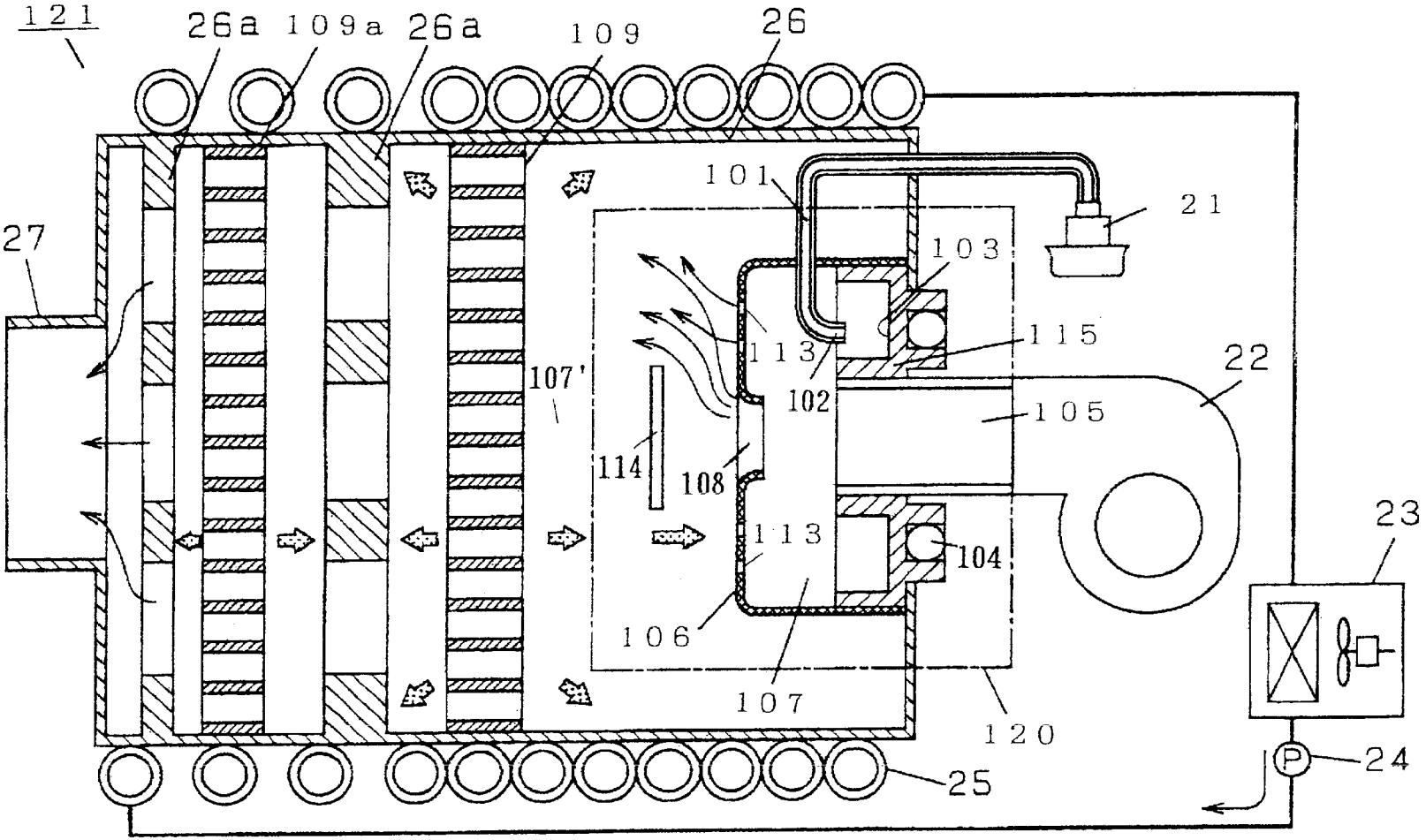
FIG. 6 is an essential sectional block diagram showing a fuel vaporizing apparatus according to another embodiment of the present invention and a catalyst combustion apparatus using the same.
Figure 7:
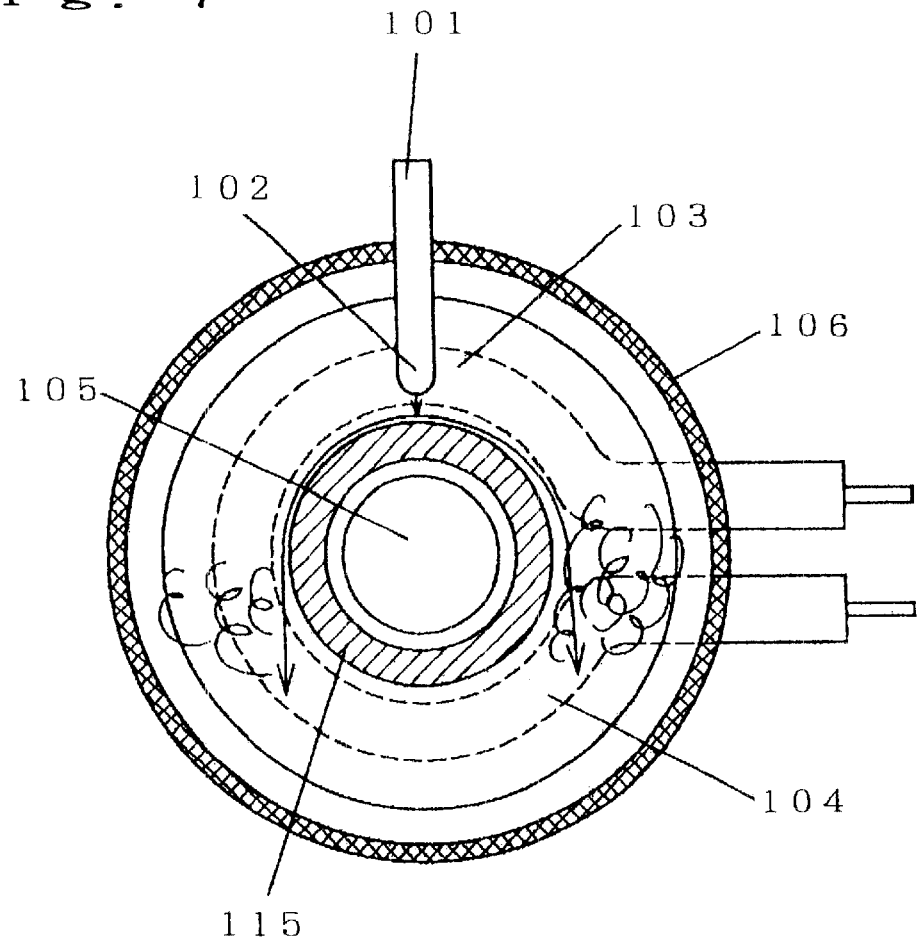
FIG. 7 is a partial block diagram showing the same fuel vaporizing apparatus and a catalyst combustion apparatus using the same.

FIG. 6 is an essential sectional block diagram showing a fuel vaporizing apparatus according to another embodiment of the present invention and a catalyst combustion apparatus using the same, and FIG. 7 is a partial block diagram showing the same apparatus.

The present embodiment is the same in basic configuration as the fuel vaporizing apparatus of (the fifth embodiment) and the catalyst combustion apparatus using the same, but is different in that a case 106 is formed with mixture circulation ports 113 for discharging the mixture out, which is circulated within the mixture space 107, that a current plate 100 is provided downstream of an air diverting port 108, that a vaporizing surface 103 is provided in a substantially vertical direction and the low end thereof is set to a lower position than the fuel jet port 102, that a liquid fuel diverting unit.115 is provided at a lower position than a fuel jet port 102, and that a heater 104 is provided along the back surface of the vaporizing surface 103. Accordingly, the description will be mainly made of these points of difference.

A fuel vaporizing apparatus 120 is configured by a fuel feed course 101; the fuel jet port 102; the vaporizing surface 103; an air feed course 105; the case 106; a first mixture space 107; a second mixture space; and the air diverting port 108, and the fuel vaporizing apparatus 120 is combined with the catalyst combustion unit 109 to constitute a catalyst combustion apparatus 121. The heater 104 is used when the temperature on the vaporizing surface 103 is so insufficient that vaporization cannot be sufficiently performed such as during rising.

Liquid fuel to be fed is jetted to the vaporizing surface 103 from the fuel jet port 102 at the tip end by way of the fuel feed course 101 from the fuel pump 21. In this case, during starting and when insufficient in amount of heat, the vaporizing surface 103 is controlled to maintain the temperature of vaporization of the fuel or higher (250° C. or higher in kerosene) by the heater 104 provided.

Of course, even if no electric power is given to the heater 104, vaporization will be performed if the temperature on the vaporizing surface 103 is high. If small in amount of combustion, the whole quantity of the liquid fuel will be vaporized in a moment after collides with the vaporizing surface 103.

If large in amount of combustion, the liquid fuel will not be vaporized in the whole quantity in a moment after the collision, but, as shown in FIG. 7, part of the fuel in a liquid state will flow down along the vaporizing surface 103 to collide with the liquid fuel diverting unit 115 projectingly provided on the vaporizing surface 103.

Since the liquid fuel diverting unit 115 is projectingly arranged, the liquid fuel is dispersed immediately. When dispersed, the area, in which the liquid fuel comes into contact with the vaporizing surface 103, is increased to be prone to obtain heat.

As described above, the liquid fuel obtains heat from the vaporizing surface 103 to vaporize the fuel in the liquid state.

With such a configuration as to disperse the liquid fuel along the vaporizing surface 103 for vaporization, it becomes possible to uniformly heat the liquid fuel for vaporization, and part of the fuel can be prevented from re-condensing.

The heater 104 is arranged along the vaporizing surface 103. With this configuration to arrange the heater 104 along the vaporizing surface 103, heat generated by the heater 104 is effectively utilized as heat of vaporization of the liquid fuel, and power consumption in the heater 104 can be reduced.

Air for combustion to be fed from a blower fan 22 by way of the air feed course 105, whose tip end is caused to penetrate the vaporizing surface 103, is diverted by a diverting port 108, part of air circulates within a first mixture space 107, and after mixed with the fuel vaporized on the vaporizing surface 103, passes through the mixture circulation port 113 provided in the case 106 to be discharged out of the mixture space 107.

Also,the greater part of the remaining air is directly discharged out of the mixture space 107 by way of the air diverting port 108 without coming into direct contact with the vaporizing surface 103.

Further, the air which has directly been discharged out of the mixture space 107 by way of the air diverting port 108 collides with the current plate 114 provided downstream of the air diverting port 108, thereafter is dispersed, and forms a flow for circulating around the air diverting port 108 and going toward the mixture discharged out of the mixture circulating port 113, and then is mixed with the mixture. Therefore, since the temperature drop is low within the mixture space 107, the liquid fuel vaporized does not re-condense.

With such a configuration as to divert air through the use of the diverting port 108, and to directly discharge a part of air out of the mixture space 107 to reduce a flow rate to be brought into contact with the vaporizing surface 103 as described above, it becomes possible to greatly reduce the amount of heat required for vaporization.

Therefore, it is possible to provide a fuel vaporizing apparatus 120 excellent in cost effectiveness with low running cost.

Further, with the configuration to cause the air thus diverted to collide with the current plate 114 for mixing, it is possible to feed. uniform mixture, and therefore, it is also possible to install any combustion unit such as flame combustion and catalyst combustion on the downstream side, and to provide a widely applicable fuel vaporizing apparatus 120.

Mixture uniformly premixed burns by catalysis in the catalyst combustion unit 109 to emit radiation heat. The heat is conducted to a heat-receiving tube 25 by way of heat-receiving fins **26*a* and a combustion barrel 26**, and is recovered by a medium flowing therein.

Also, a part of the radiation heat is effectively absorbed by the case 106 made of high-emissivity material, conducts to the vaporizing surface 103 and is utilized for vaporization of the fuel. Further, from combustion gas to be discharged from the catalyst combustion unit 109, the heat is recovered by the heat-receiving fins **26*a* before emitted from an exhaust flue 27, and is recovered by the medium by way of the heat-receiving tube 25**.

The medium is circulated by the operation of a pump 24, and when it is carried to an external radiator 23, the medium gives off the heat here and it is utilized as a heat source outside.

A fuel vaporizing apparatus and a catalyst combustion apparatus using the same are configured as described above, whereby it is possible to provide a fuel vaporizing apparatus and a catalyst combustion apparatus which reduce electric power required to vaporize the fuel and do not re-condense.

In this respect, in the present embodiment, the place for diverting air for combustion has been provided on the downstream side of the vaporizing surface 103, but it may be possible to provide it on the upstream side of the vaporizing surface 103, and to feed air for combustion after diverting in advance. Although the configuration of the fuel vaporizing apparatus 120 becomes slightly complicated, the same effect as described above can be obtained (See 105' of FIG. 5).

Seventh Embodiment

Figure 8:
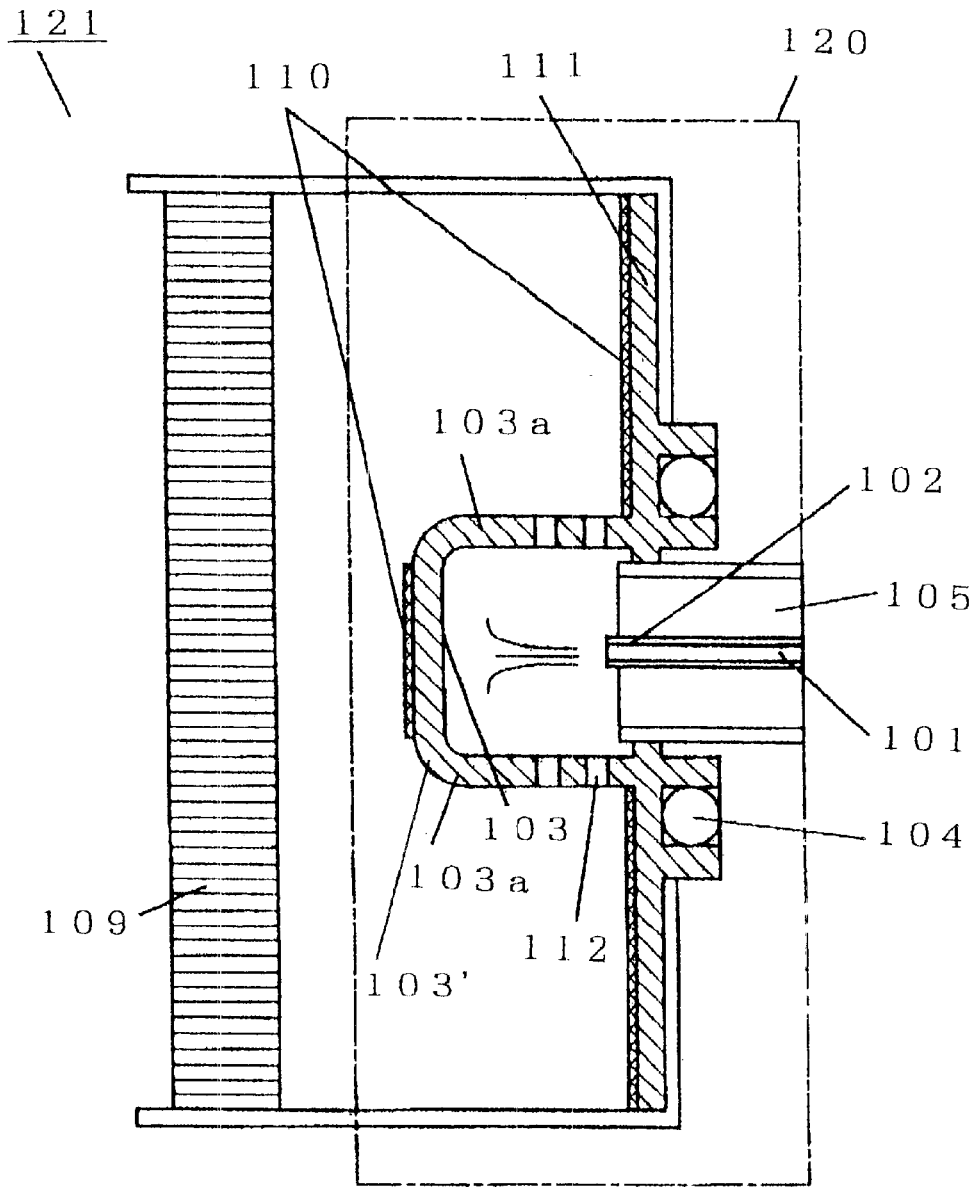
FIG. 8 is an essential sectional block diagram showing a fuel vaporizing apparatus according to another embodiment of the present invention and a catalyst combustion apparatus using the same.

FIG. 8 is an essential sectional view showing a catalyst combustion apparatus according to another embodiment of the present invention. The present embodiment is the same in basic configuration as the fuel vaporizing apparatus of (the fifth embodiment) and the catalyst combustion apparatus using the same, but is different in that the vaporizing surface 103 and a radiation heat receptor 111 are integrally configured, that the catalyst combustion unit 109 is arranged to oppose to the radiation heat receptor 111, that the radiation heat receptor 111 is covered with high-emissivity material 110, that the vaporizing surface 103 is protruded from the radiation heat receptor 111 on the catalyst combustion unit 109 side, and that the back surface of the vaporizing surface 103 is covered with high-emissivity material 110. The description will be mainly made of these points of difference.

The fuel vaporizing apparatus 120 is configured by a fuel feed course 101, a fuel jet port 102, a vaporizing surface 103 of a box-shaped vaporizing unit 103' and an air feed course 105, and the fuel vaporizing apparatus 120 is combined with the catalyst combustion unit 109 to constitute a catalyst combustion apparatus 121, and high-emissivity film 110 is further provided in order to provide at least the back surface of the vaporizing surface 103, which is the surface on the catalyst combustion unit 109 side, with high emissivity. This is used in order to improve the performance of the fuel vaporizing apparatus 120. The heater 104 is used when the temperature of the vaporizing surface 103 is insufficient. The vaporizing unit 103' is box-shaped, and its base portion forms the vaporizing surface 103, and its side surface 3*a* is formed with a vaporizing unit opening 112.

Also, the fuel feed course 101 and the air feed course 105 are both adapted to blow off the fuel or air horizontally respectively, for causing it to collide with the vaporizing surface 103.

The radiation heat receptor 111 is integrally configured with the vaporizing surface 103 in terms of conduction of heat, and the catalyst combustion unit 109 is arranged downstream of the radiation heat receptor 111. In other words, the plate-shaped radiation heat receptor 111 is in an opposed state to the catalyst combustion unit 109, and further at the center of the radiation heat receptor 111, the box-shaped vaporizing unit 103' is arranged, and protrudes on the catalyst combustion unit 109 side.

Liquid fuel to be fed is jetted onto the vaporizing surface 103 through the fuel jet port 102 at the tip end by way of the fuel feed course 101. Air for combustion is also jetted onto the vaporizing surface 103 by way of the air feed course 105 arranged around the fuel feed course 101. The vaporizing surface 103 is vertical.

In this case, the vaporizing surface 103 is controlled to exceed the temperature of vaporization of the fuel (250° C. or higher in kerosene), the liquid fuel is vaporized after it collides with the vaporizing surface 103, the fuel vapour vaporized is dispersed to form a flow on the air side to be circulated over this periphery, and is mixed with air into mixture.

Liquid fuel, which could not be vaporized on the vaporizing surface 103 at this time, also flows down along the vaporizing surface 103 because the vaporizing surface 103 is vertical, and is accumulated on the underside of a member 3*a* for joining the vaporizing surface 103 to the radiation heat receptor 111, where heat is obtained to vaporize.

This mixture is fed to the catalyst combustion unit 109 provided downstream by way of the vaporizing unit opening 112, and oxidation reaction is performed here. Due to this heat of reaction, the temperature on the surface of the upper stream of the catalyst combustion unit 109 is maintained to exceed 500° C. capable of continuing the combustion and at 900° C., which is temperature limit at which durability is taken into consideration, or lower.

At this time, an amount of heat corresponding to 50 to 60% of calorific value of the liquid fuel to be fed is radiated on the upstream side of the catalyst combustion unit 109. Since the radiation heat receptor 111 is integrally configured with the vaporizing surface 103 and the catalyst combustion unit 109 is arranged downstream of the radiation heat receptor 111, the back surface of the vaporizing surface 103 and the radiation heat receptor 111 are opposed to the catalyst combustion unit 109, and those are further entirely or partially covered with high-emissivity film 110.

As a result, of radiation heat to be emitted from the catalyst combustion unit 109, 90% or higher, that is, 50% or higher of the calorific value is absorbed by the back surface of a radiation surface 3 and the radiation heat receptor 111.

Further, since the vaporizing surface 103 is caused to protrude from the radiation heat receptor 111 on the catalyst combustion unit 109 side, radiation heat from a wider range reaches the back surface thereof. The heat of absorption here is not radiated to the outside, but is directly utilized as heat of vaporization of the liquid fuel, and therefore, it is possible to prevent a part of the fuel from re-condensing, and there is the effect that the power consumption of the heater 104 is reduced at the same time. Further, the radiation heat from the catalyst combustion unit 109 is also utilized to preheat the premixed mixture, and is flowed back to the catalyst combustion unit 109 again.

With the configuration in which the vaporizing surface 103 is caused to protrude from the radiation heat receptor 111 on the catalyst combustion unit 109 side as described above, there is the effect that the power consumption of the heater 104 can be greatly reduced with further simple configuration without discretely installing a channel controller or the like.

Therefore, it is possible to provide a catalyst combustion apparatus 121 having high heat utilization efficiency, excellent in energy-saving property and cost effectiveness. Further, even if the vaporizing unit opening 112 is used as a flame port, radiation heat from flames heats the radiation heat receptor 111 and the vaporizing unit opening 112 to heat the vaporizing surface 103 through conduction of heat, and therefore, it is applicable as a fuel vaporizing apparatus 120 for a flame combustion apparatus, and a widely-applicable fuel vaporizing apparatus 120 can be provided.

In this respect, in the present embodiment, the surface of the radiation heat receptor 111 on the catalyst combustion unit 109 side has been covered with high-emissivity film 110, but it may be possible to use the radiation heat receptor 111 itself made of base material having high-emissivity, and the similar effect to the above-described one can be obtained.

In the case where the radiation heat receptor 111 is configured by base material having high thermal conductivity such as copper and aluminum, it becomes possible to more effectively conduct radiation heat from the surface of the upper stream of the catalyst combustion unit 109 to the vaporizing surface 103, and further the effect equal to or better than the above-described one can be expected.

In this respect, in the above-described fifth to seventh embodiments, the description has been made of the catalyst combustion apparatus and the fuel vaporizing apparatus for liquid fuel, but the present invention is, of course, not limited thereto. In other words, the following cases are also included in the present invention.

For the carrier in the catalyst combustion unit, ceramic honeycomb is used, but as long as it has a multiplicity of conductive holes in which premixed mixture can be circulated, it is not limited to its material and shape, but a sintered body of, for example, ceramics and metal, metallic honeycomb and metallic nonwoven material, a plaiting body of ceramic fiber or the like can be utilized, the shape is also not limited to a flat plate, but a curved shape, a cartridge shape or a corrugated panel shape or the like can be arbitrarily set in accordance with processability and applications of the material.

As active constituent, there are generally noble metal of platinum group such as platinum, palladium, and rhodium, and their mixing body, other metals and their oxide, and their mixed composition may be used, and the active constituent responsive for type of fuel and conditions for use can be selected.

INDUSTRIAL APPLICABILITY

As described above, a catalyst combustion apparatus according to the present invention is capable of greatly reducing power consumption of a vaporizing unit heater required to control the vaporizing unit to exceed a fixed temperature. Therefore, it is possible to provide a catalyst combustion apparatus having high heat utilization efficiency, excellent in energy-saving property and cost effectiveness.

With the configuration in which the air to be fed from the air feed course is caused not to be brought into contact with the vaporizing unit as far as possible, heat of conduction and radiation heat from the catalyst heating unit are mainly utilized to vaporize the liquid fuel, and therefore, the amount of heat to be fed to the vaporizing unit can be reduced to one eighth to one sixth when vaporized as premixed mixture.

The power consumption of the vaporizing unit heater required to control the vaporizing unit to exceed a fixed temperature can be reduced to substantially zero over all the combustion amount area as described above, and spontaneous combustion can be realized.

Therefore, it is possible to provide a catalyst combustion apparatus excellent in cost effectiveness with low running cost.

Further, since the greater part of heat recovery from the catalyst heating unit to the vaporizing unit is performed as described above, even when no catalyst combustion unit is provided downstream, that is, it is also applicable to a flame combustion apparatus, and a widely applicable vaporizing apparatus can be provided.

Further, in the case where a piezo-electric igniter is used as an igniter to be used when catalyst combustion is started by flame combustion, a catalyst combustion apparatus without power supply having a high degree of freedom in terms of installation place or the like can be realized.

What is claimed is:

1. A catalyst combustion apparatus comprising:

a fuel feed course for feeding liquid fuel;

an air feed course for feeding air;

vaporizing unit for heating fuel to be fed from said fuel feed course to vaporize;

a mixing unit for mixing vaporized fuel fed from said vaporizing unit with air fed from said air feed course;

a catalyst heating unit disposed on a downstream side of said mixing unit in contact with or in close proximity to said vaporizing unit in terms of conduction of heat, for carrying an oxidation catalyst component; and solely a single catalyst combustion unit, provided on a downstream side of said catalyst heating unit, having a multiplicity of conductive holes, wherein:

said vaporizing unit is capable of utilizing heat from said catalyst heating unit;

the vaporizing unit is coupled to said catalyst heating unit for conduction of heat;

said fuel feed is disposed within said vaporizing unit;

said catalyst heating unit is box-shaped;

on a base portion of said box-shaped catalyst heating unit, there are formed a plurality of holes; and an air jet nozzle of said air feed course is disposed to face so as to intersect the base portion of said box-shaped catalyst heating unit at right angles.

2. The catalyst combustion apparatus according to claim 1, wherein at a position, where air jetted from said air jet nozzle collides, of the base portion of said box-shaped catalyst heating unit, there is provided a diverting air port with a larger diameter than said plurality of holes, and a part of air jetted from said air jet nozzle goes out of said diverting air port while the remaining part circulates within the space portion of said box-shaped catalyst heating unit.

3. The catalyst combustion apparatus according to claim 2, wherein on the downstream side of air jetted from said diverting air port flows, there is provided a current plate for changing a flow direction of the air.

4. The catalyst combustion apparatus according to claim 3, wherein upstream of said catalyst combustion unit, a heater for heating said catalyst combustion unit is provided in close proximity, and said current plate is disposed in contact with said heater.

5. The catalyst combustion apparatus according to claim 4, wherein said current plate carries an oxidation catalyst component.

6. A fuel vaporizing apparatus, characterized in that said apparatus comprises:

a fuel feed course for feeding liquid fuel;

an air feed course for feeding air;

a vaporizing unit having a vaporizing surface for heating fuel to be fed from said fuel feed course to vaporize said liquid fuel;

a first mixing space for mixing air fed from said air feed course with fuel vaporized in said vaporizing unit; and a second mixing space provided on the downstream side of said first mixing space, and a tip end of said air feed course penetrates said vaporizing surface to thereby cause a part of air jetted from said tip end to flow out of said first mixing space without being affected by heating in said vaporizing unit, while the remaining air is mixed with said fuel vaporized within said first mixing space, into mixture, to flow out of said first mixing space, and in said second mixing space in the outside of said first mixing space, said air flowed out is mixed with said mixture.

7. The fuel vaporizing apparatus according to claim 6, wherein said vaporizing unit is box-shaped, said vaporizing surface is formed on a tray-shaped base portion of said vaporizing unit, said first mixing space is formed by a box-shaped case, which is disposed so as to cover said box-shaped vaporizing unit, said second mixing space is formed in the outside of said case, and a case-shaped base portion of said first mixing space is facing the tip end of said air feed course, and at a position of said base portion, to which air to be jetted from said tip end collides, there is formed an air diverting port which diverts the air, and a first part of air jetted from the tip end of said air feed course flows out of said air diverting port without mixing with said fuel vaporized, and a second part of air jetted from the tip end of the air feed course is mixed with said fuel vaporized in said case-shaped first mixing space, to be flowed out of said air diverting port, and air, which flows out of said air diverting port, and said mixture are further mixed in said second air mixing space.

8. A catalyst combustion apparatus using the fuel vaporizing apparatus according to claim 7, wherein said catalyst combustion apparatus further comprises a catalyst combustion unit provided on the downstream side of said second mixing space, having a multiplicity of conductive holes, and said vaporizing unit is coupled to said case in terms of conduction of heat, and a surface of said case on a catalyst combustion unit side is formed with film of higher emissivity than other portions.

9. The fuel vaporizing apparatus according to claim 6, wherein said air feed course branches in its course, and another tip end, which is different from said tip end, is directly disposed in said second mixing space.

10. The fuel vaporizing apparatus according to claim 6, wherein a vaporizing surface located in said vaporizing unit is provided in a substantially vertical direction, and at a lower position than the tip end of said fuel feed course, there is provided a liquid fuel diverting unit for diverting said liquid fuel.

11. A catalyst combustion apparatus using the fuel vaporizing unit according to claim 6, wherein said catalyst combustion apparatus further comprises a catalyst combustion unit provided on the downstream side of said second mixing space, having a multiplicity of conductive holes, and said vaporizing unit is capable of utilizing heat from said catalyst combustion unit.

12. A catalyst combustion apparatus using a fuel vaporizing apparatus, the fuel vaporizing apparatus comprising:

a fuel feed course for feeding liquid fuel;

an air feed course for feeding air; and a vaporizing unit having a vaporizing surface for heating fuel to be fed from said fuel feed course to vaporize said liquid fuel, and wherein said vaporizing unit is formed into a box-shaped case; within said case, a tip end of said fuel feed course and a tip end of said air feed course are arranged, fuel is jetted through the tip end of said fuel feed course toward the vaporizing surface located in a base portion of said case; and within said case, vaporized fuel and air jetted from the tip end of said air feed course are mixed to flow out of an opening located on a side of said case;

wherein the catalyst combustion apparatus further comprises a catalyst fuel unit provided on the downstream side of said vaporizing unit, having a multiplicity of conductive holes, and wherein a full or partial surface of a base portion having a vaporizing surface of said case on a catalyst combustion unit side is formed with higher emissivity film than other portions.

13. The catalyst combustion apparatus according to claim 12, wherein said apparatus comprises a radiation heat receptor disposed to oppose to said catalyst combustion unit, and coupled to said vaporizing unit in terms of conduction of heat, and said case-shaped case is projectingly formed from said radiation heat receptor on said catalyst combustion unit side.

14. The catalyst combustion apparatus according to claim 13, wherein said full or partial radiation heat receptor is formed with higher emissivity film than other portions.

15. A catalyst combustion apparatus comprising:

a fuel feed course for feeding liquid fuel;

an air feed course for feeding air;

mixing unit for mixing fuel to be fed from said fuel feed course with air to be fed from said air feed course;

a vaporizing unit for heating mixture obtained by mixing in said mixing unit to vaporize said liquid fuel;

a catalyst heating unit disposed on a downstream side of said vaporizing unit in contact with or in close proximity to said vaporizing unit in terms of conduction of heat, for carrying an oxidation catalyst component; and solely a single catalyst combustion unit, provided on a downstream side of said catalyst heating unit, having a multiplicity of conductive holes, and wherein said vaporizing unit is capable of utilizing heat from said catalyst heating unit;

wherein:

said catalyst heating unit is integrally coupled to and extends in a direction away from directly from said vaporizing unit for conduction of heat, is box-shaped, and has a space portion for communicating to an internal space of said vaporizing unit;

on a base portion of said box-shaped catalyst heating unit, there are formed a plurality of holes, and existence of said base portion restrains a flow of said mixture toward said catalyst combustion unit; and said mixture is further mixed in said space portion of said box-shaped catalyst heating unit.

16. A catalyst combustion apparatus comprising:

a fuel feed course for feeding liquid fuel;

an air feed course for feeding air;

a vaporizing unit for heating fuel to be fed from said fuel feed course to vaporize;

a mixing unit for mixing vaporized fuel fed from said vaporizing unit with air fed from said air feed course;

a catalyst heating unit disposed on a downstream side of said mixing unit in contact with or in close proximity to said vaporizing unit in terms of conduction of heat, for carrying an oxidation catalyst component; and solely a single catalyst combustion unit, provided on a downstream side of said catalyst heating unit, having a multiplicity of conductive holes, wherein:

said vaporizing unit is capable of utilizing heat from said catalyst heating unit;

the vaporizing unit is coupled to said catalyst heating unit for conduction of heat;

said fuel feed is disposed within said vaporizing unit;

said catalyst heating unit is box-shaped; and air fed from said air feed course diverts, and a part is fed to said mixing unit while the remaining part is fed to said catalyst combustion unit.

17. A catalyst combustion apparatus comprising:

a fuel feed course for feeding liquid fuel;

an air feed course for feeding air;

vaporizing unit for heating fuel to be fed from said fuel feed course to vaporize;

a mixing unit for mixing vaporized fuel fed from said vaporizing unit with air fed from said air feed course;

a catalyst heating unit disposed on a downstream side of said mixing unit in contact with or in close proximity to said vaporizing unit in terms of conduction of heat, for carrying an oxidation catalyst component; and solely a single catalyst combustion unit, provided on a downstream side of said catalyst heating unit, having a multiplicity of conductive holes, wherein:

said vaporizing unit is capable of utilizing heat from said catalyst heating unit;

the vaporizing unit is coupled to said catalyst heating unit for conduction of heat;

said fuel feed is disposed within said vaporizing unit;

said catalyst heating unit is box-shaped;

an air jet nozzle of said air feed course penetrates said vaporizing unit and is disposed in the vicinity of said catalyst heating unit; and that a fuel jet port of said fuel feed course is disposed in said vaporizing unit.

18. A catalyst combustion apparatus comprising:

a fuel feed course for feeding liquid fuel;

an air feed course for feeding air;

a vaporizing unit for heating fuel to be fed from said fuel feed course to vaporize;

a mixing unit for mixing vaporized fuel fed from said vaporizing unit with air fed from said air feed course;

a catalyst heating unit disposed on a downstream side of said mixing unit in contact with or in close proximity to said vaporizing unit in terms of conduction of heat, for carrying an oxidation catalyst component; and solely a single catalyst combustion unit, provided on a downstream side of said catalyst heating unit, having a multiplicity of conductive holes, wherein:

said vaporizing unit is capable of utilizing heat from said catalyst heating unit;

the vaporizing unit is coupled to said catalyst heating unit for conduction of heat, said fuel feed is disposed within said vaporizing unit;

said catalyst heating unit is box-shaped;

a vaporizing surface in said vaporizing unit is provided in a substantially vertical direction, and at a lower position than a tip end of said fuel feed course, there is provided, on the vaporizing surface, a liquid fuel diverting unit for diverting a flow of said liquid fuel jetted on the vaporizing surface and not yet vaporized.

* * * * *

UNITED STATES PATENT AND TRADEMARK OFFICE

CERTIFICATE OF CORRECTION

PATENT NO. : 6,632,085 B1
DATED : October 14, 2003
INVENTOR(S) : Suzuki et al.

It is certified that error appears in the above-identified patent and that said Letters Patent is hereby corrected as shown below:

Title page,
Item [56], FOREIGN PATENT DOCUMENTS, please delete "JP 59-91909 A" and substitute therefor -- JP 59-71909 A --.

Signed and Sealed this

Sixth Day of April, 2004

JON W. DUDAS
*Acting Director of the United States Patent and Trademark Office*